US008910722B2

(12) United States Patent
Bishop et al.

(10) Patent No.: US 8,910,722 B2
(45) Date of Patent: Dec. 16, 2014

(54) SLIP-DEPLOYED ANTI-EXTRUSION BACKUP RING

(75) Inventors: David S. Bishop, Houston, TX (US); Douglas J. Lehr, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 242 days.

(21) Appl. No.: 13/471,900

(22) Filed: May 15, 2012

(65) Prior Publication Data

US 2013/0306330 A1 Nov. 21, 2013

(51) Int. Cl.
*E21B 33/128* (2006.01)

(52) U.S. Cl.
USPC ..... 166/387; 166/196; 166/118; 166/138

(58) Field of Classification Search
USPC ..... 166/387, 196, 118, 138
See application file for complete search history.

(56) References Cited

U.S. PATENT DOCUMENTS

| | | | | |
|---|---|---|---|---|
| 6,840,328 | B2 | 1/2005 | McKee et al. | |
| 7,762,323 | B2 | 7/2010 | Frazier | |
| 8,083,001 | B2 | 12/2011 | Conner et al. | 166/387 |
| 2004/0007366 | A1 * | 1/2004 | McKee et al. | 166/387 |
| 2008/0073074 | A1 * | 3/2008 | Frazier | 166/138 |

* cited by examiner

*Primary Examiner* — Cathleen Hutchins
*Assistant Examiner* — Taras P Bemko
(74) *Attorney, Agent, or Firm* — Shawn Hunter

(57) ABSTRACT

Arrangements and packer devices having anti-extrusion backup rings that are expanded radially outwardly by a setting mechanism that lies proximate the elastomeric packer element that is being protected against extrusion. The setting mechanism can be a slip assembly that has a radially expandable slip element.

9 Claims, 2 Drawing Sheets

SLIP-DEPLOYED ANTI-EXTRUSION BACKUP RING

BACKGROUND OF THE INVENTION

1. Field of the Invention

The invention relates generally to the design of packer devices.

2. Description of the Related Art

Anti-extrusion backup rings are used to prevent or reduce extrusion of deformable elastomeric packer elements for packer devices in wellbores. Other backup rings partially encase an end portion of the elastomeric packer element and are therefore, expanded radially outwardly as the packer element expands radially during setting. Backup rings of this type are discussed in U.S. Pat. No. 8,083,001 issued to Conner et al. which is owned by the assignee of the present invention and is herein incorporated by reference.

SUMMARY OF THE INVENTION

The invention provides packer devices having one or more anti-extrusion backup rings that are expanded radially outwardly by the radial expansion of a setting mechanism that lies proximate the elastomeric packer element that is being protected against extrusion. In certain embodiments, the setting mechanism is a slip assembly that has a radially expandable slip element. In particular embodiments, the slip assembly is set by axial movement of the slip element over a setting cone. In a described embodiment, the anti-extrusion backup ring has an interior portion that extends along the end wall of the packer element and an exterior portion that is substantially perpendicular to the interior portion. In the described embodiment, the exterior portion overlies a portion of the slip element. The slip element urges the backup ring into mechanical or intimate contact with a surrounding tubular when the slip element is set against the surrounding tubular. Outward radial expansion of the slip element will urge the exterior portion of the backup ring radially outwardly. In a described embodiment, the exterior portion of the backup ring is urged into contact with the surrounding tubular by the slip element. When so set, the backup ring prevents or reduces axial extrusion of the packer element past the backup ring in the direction of the slip assembly.

In another described embodiment, the backup ring takes the form of an annular spring that radially surrounds the cone of the slip assembly. During setting of the packer device, the slip element urges the spring into a wedged position between the cone and the surrounding tubular so that the wedged spring acts as backup ring to prevent extrusion of the packer element.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
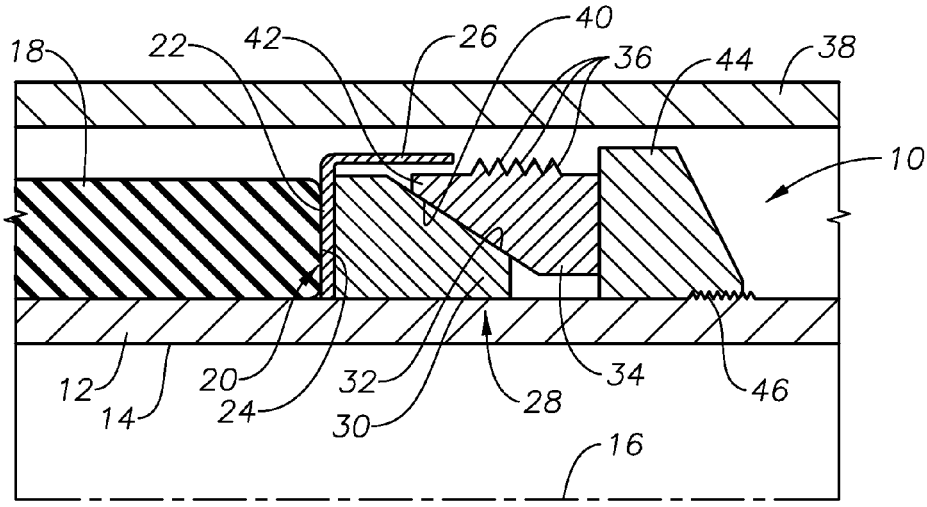
FIG. 1 is a one-quarter side cross-sectional view of an unset exemplary packer device having an anti-extrusion backup ring in accordance with the present invention.

FIG. 1 illustrates an exemplary compression-set packer device 10 that includes an interior cylindrical mandrel 12 that defines an interior flowbore 14 having central axis 16 along its length. As the general construction and operation of a compression-set packer device is well known, it will not be discussed in detail here.

A compressible, or compression-set, packer element 18 radially surrounds the mandrel 12. The packer element 18 is preferably formed of a deformable elastomer, as is known in the art. An anti-extrusion backup ring 20 is located adjacent the packer element 18. The backup ring 20 has an interior portion 22 that extends radially outwardly from the mandrel 12 and along the end wall 24 of the packer element 18. The backup ring 20 also has an exterior portion 26 that, in the depicted embodiment, is substantially perpendicular to the interior portion 22. In particular embodiments, the backup ring 20 is formed of metal. A suitable metal for this application is annealed 8620 steel. In other particular embodiments, the backup ring 20 is formed of a non-metallic material such as carbon epoxy and other composites. In preferred embodiments, the backup ring 20 has a rigidity that allows it to be deployed with a setting force that is usual and customary for setting of the packer element 18. In particular embodiments, the setting force would be in the range of 5,000-15,000 lbs. In accordance with other embodiments, the backup ring 20 could be a non-metallic petal-style backup ring that is not flexible, but has a designated break point.

In accordance with other particular embodiments of the present invention, the exterior portion 26 of the backup ring 20 is slotted so that the backup ring 20 is of the petal variety. Also in certain embodiments, this petal-style ring is formed of non-metallic material.

A slip assembly, generally shown at 28, radially surrounds the mandrel 12 and includes a cone 30 that is axially slidable upon the mandrel 12. The cone 30 presents a ramped outer radial setting surface 32. The slip assembly 28 also includes a slip element 34. The slip element 34 is typically radially segmented, but need not be so. The slip element 34 preferably has teeth 36 to create a biting engagement with a surrounding tubular member 38 when set. The slip element 34 presents a radially inwardly-facing slanted surface 40 that is complimentary to the surface 32 of the cone 30. The slip element 34 is located so that the slanted surface 40 is in contact with the surface 32 of the cone 30. It is noted that, in the unset position, shown in FIG. 1, an end portion 42 of the slip element 34 is disposed radially within the exterior portion 26 of the backup ring 20.

A ring 44 also radially surrounds the mandrel 12 and is affixed to the mandrel 12 by threaded or bonded connection 46. The ring 44 contacts the slip element 34.

Figure 2:
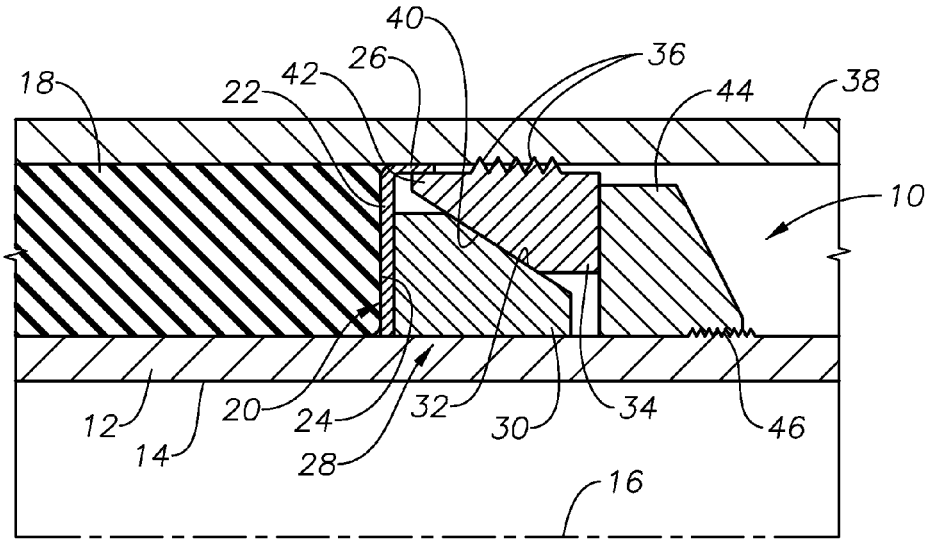
FIG. 2 is a one-quarter side cross-sectional view of the packer device of FIG. 1, now in a set position.

In order to set the packer device 10, the components surrounding the mandrel 12 are axially compressed against the ring 44 as is known in the art. As FIG. 2 illustrates, the packer element 18 will expand radially outwardly and into sealing contact with the surrounding tubular 38. As the cone 30 is moved axially toward the ring 44, the slip element 34 is moved radially outwardly due to sliding movement of the slip element 34 upon the ramped surface 32 of the cone 30. The slip element 34 is moved radially outwardly until its teeth 36 bitingly engage the surrounding tubular 38.

The radial outward movement of the slip element 34 also energizes the backup ring 20. The interior portion 24 of the backup ring 20 is urged against the packer element 18. The exterior portion 26 of the backup ring 20 is also preferably brought into contact with the surrounding tubular 38 by the slip element 34. The backup ring 20 now functions as an anti-extrusion barrier which will prevent extrusion of the packer element 18 axially toward the slip assembly 28. Although only a single backup ring 20 is depicted associated with a single axial end wall 24 of the packer element 18, it should be understood that a similar to backup ring and setting arrangement could be used for the opposite axial end of the packer element 18.

It will be understood that the invention provides an arrangement for preventing axial extrusion of a packer element that is set within a surrounding tubular. This arrangement includes the anti-extrusion backup ring 20 as well as the setting mechanism that is provided in certain embodiments by the slip assembly 28.

In addition, it should be understood that the invention provides methods for establishing an anti-extrusion backup seal for a packer element 18 in a packer device 10 to be set within a surrounding tubular 38. In accordance with these methods, an anti-extrusion backup ring 20 is placed proximate an end wall 24 of the packer element 18. The backup ring 20 is then energized to prevent extrusion by a setting mechanism other than the packer element 18. In particular embodiments, the setting mechanism is a slip assembly 28 and energizes the backup ring 20 by urging a slip element 34 radially outwardly to cause the backup ring 20 to be urged against the packer element 18. In certain embodiments, the slip element 34 urges a portion of the backup ring 20 into engagement with the surrounding tubular 38.

The inventors have found that the arrangements and methods of the present invention provide for positive energizing of the backup ring 20. Since the slip element 34 is formed of a rigid material or assemblage of rigid materials, it will provide for a rigid anchoring of the backup ring 20 against the surrounding tubular 38.

Figure 3:
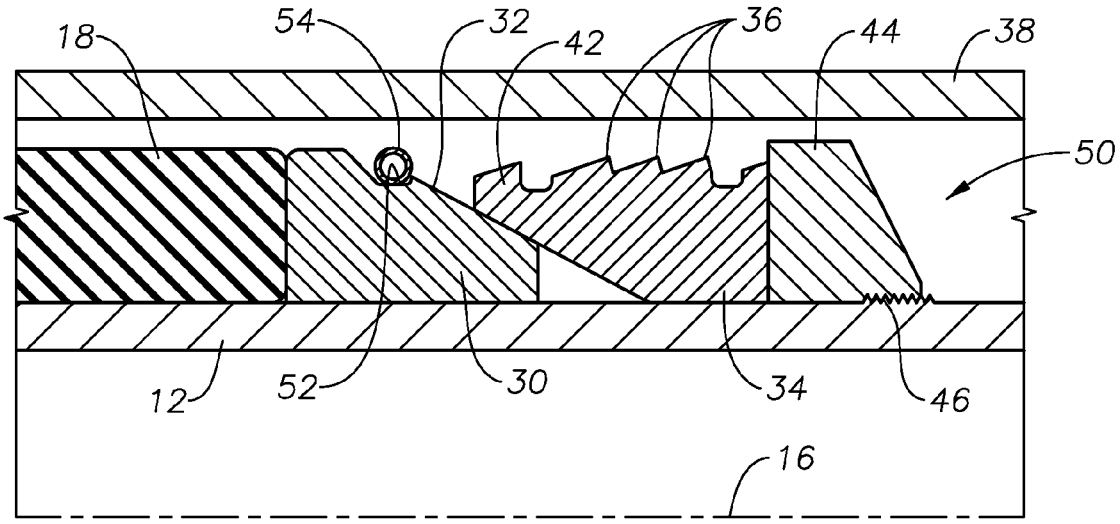
FIG. 3 is a one-quarter side cross-sectional view of an unset packer device having an exemplary alternative anti-extrusion backup ring in accordance with the present invention.
Figure 4:
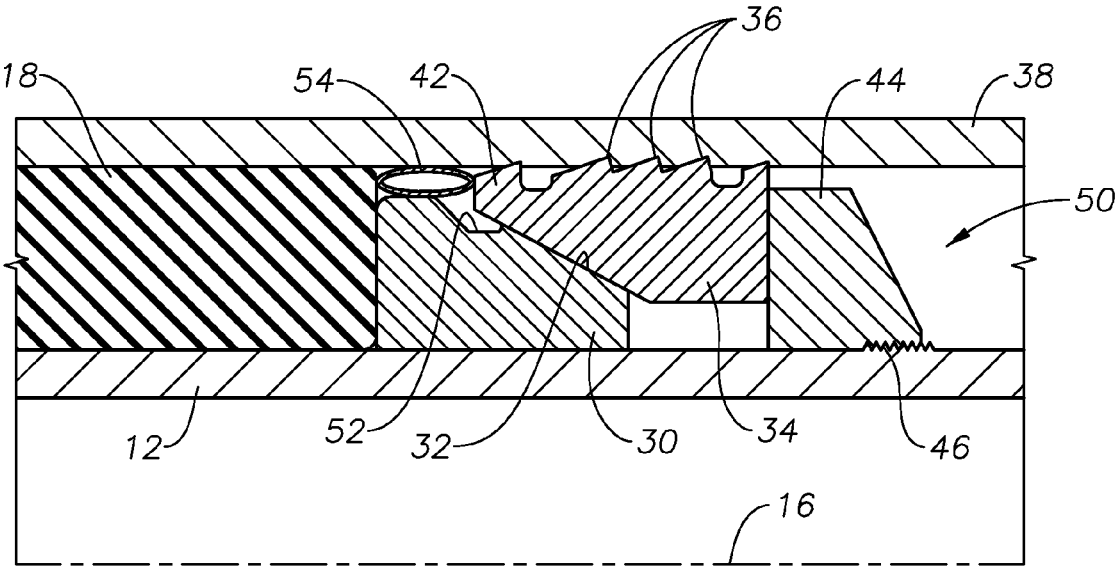
FIG. 4 is a one-quarter side cross-sectional view of the packer device of FIG. 3, now in a set position.

FIGS. 3 and 4 illustrate an alternative compression-set packer device 50 having a packer element 18 that radially surrounds mandrel 12. The packer device 50 is constructed and operates in the manner as the packer device 10 described previously except where indicated otherwise. The inclined outer surface 32 of cone 30 preferably includes an annular recess 52. An annular spring 54 is disposed on the outer surface 32 of the cone 30. Preferably, the spring 54 resides within the recess 52. In one embodiment, the spring 54 is formed of a non-metallic ceramic material, such as carbon fiber reinforced PEEK (polyether ether ketone). Suitable annular springs for use as the spring 54 are available commercially from a number of manufacturers, including Automated Dynamics of Schenectady, N.Y.

When the packer device 50 is moved from the unset position (FIG. 3) to the set position (FIG. 4) by compression, the end portion 42 of the slip element 34 will contact the spring 54 and urge it over the cone 30. The spring 54 is then wedged between the cone 30 and the surrounding tubular 38 so that the spring 54 functions as an anti-extrusion backup member that will prevent extrusion of the packer element 18 axially within the surrounding tubular 38. It is noted that the spring 54 may deform (flatten) cross-sectionally as it is wedged.

The foregoing description is directed to particular embodiments of the present invention for the purpose of illustration and explanation. It will be apparent, however, to those skilled in the art that many modifications and changes to the embodiment set forth above are possible without departing from the scope and the spirit of the invention.

What is claimed is:

1. An arrangement for preventing axial extrusion of a compression-set packer element of a packer device set within a surrounding tubular, the arrangement comprising:

an anti-extrusion backup ring radially surrounding a central mandrel and located proximate the packer element;

a setting mechanism for energizing the backup ring to prevent axial extrusion of the packer element within the surrounding tubular, the setting mechanism including a slip element that is radially expandable to create an anchoring engagement with a surrounding tubular, and wherein the anti-extrusion backup ring has an exterior portion that overlies a portion of the slip element; and wherein radial expansion of the slip element contacts the exterior portion and urges the exterior portion into contact with the surrounding tubular.

2. The arrangement of claim 1 wherein the anti-extrusion backup ring further comprises:

a radially interior portion that lies along an end wall of the packer element.

3. The arrangement of claim 1 wherein the backup ring is formed of metal.

4. The arrangement of claim 1 wherein the backup ring is formed of a non-metallic material.

5. A packer device that is to be set within a surrounding tubular, the packer device comprising:

a central mandrel;

a compression-set packer element radially surrounding the mandrel;

an anti-extrusion backup ring radially surrounding the mandrel and located adjacent the packer element; and a setting mechanism for energizing the backup ring to prevent axial extrusion of the packer element within the surrounding tubular, the setting mechanism including a slip element that is radially expandable to create an anchoring engagement with a surrounding tubular, and wherein the anti-extrusion backup ring has an exterior portion that overlies a portion of the slip element; and wherein radial expansion of the slip element contacts the exterior portion and urges the exterior portion into contact with the surrounding tubular.

6. The packer device of claim 5 wherein the anti-extrusion backup ring further comprises:

a radially interior portion that lies along an end wall of the packer element.

7. The packer device of claim 5 wherein the backup ring is formed of metal.

8. The packer device of claim 5 wherein the backup ring is formed of a non-metallic material.

9. A method of establishing an anti-extrusion backup seal for a packer element in a packer device to be set within a surrounding tubular, the method comprising the steps of:

radially surrounding a central mandrel with the packer element;

placing an anti-extrusion backup ring proximate an end wall of the packer element;

locating a setting mechanism proximate the backup ring, the setting mechanism including a slip element that is radially expandable to create an anchoring engagement with a surrounding tubular, the anti-extrusion backup ring haying an exterior portion that overlies a portion of the slip element; and radially expanding the slip element to contact the exterior portion and urge the exterior portion into contact with the surrounding tubular.

* * * * *